US006840747B2

(12) United States Patent
Kim et al.

(10) Patent No.: US 6,840,747 B2
(45) Date of Patent: Jan. 11, 2005

(54) POSITIVE-DISPLACEMENT OIL PUMP

(75) Inventors: Hyun-Jin Kim, Seoul (KR); Tai-Jin Lee, Incheon (KR)

(73) Assignee: University of Incheon, Incheon (KR)

( * ) Notice: Subject to any disclaimer, the term of this patent is extended or adjusted under 35 U.S.C. 154(b) by 51 days.

(21) Appl. No.: 10/355,382

(22) Filed: Jan. 30, 2003

(65) Prior Publication Data

US 2004/0033149 A1 Feb. 19, 2004

(30) Foreign Application Priority Data

Aug. 13, 2002 (KR) ..... 10-2002-0047714

(51) Int. Cl.[7] ..... F01M 1/06
(52) U.S. Cl. ..... 417/545; 417/555.1; 184/6.18
(58) Field of Search ..... 417/555.1, 461, 417/462, 545, 547; 92/31; 138/44; 184/6.18

(56) References Cited

U.S. PATENT DOCUMENTS 3,602,614 A * 8/1971 Zelle et al. ..... 417/461
4,945,778 A * 8/1990 Weyer ..... 74/89.24
5,303,275 A * 4/1994 Kobsa ..... 376/352

FOREIGN PATENT DOCUMENTS

JP 356020796 A * 2/1981 ..... F04C/18/356

* cited by examiner

*Primary Examiner*—Michael Koczo
(74) *Attorney, Agent, or Firm*—Schmeiser, Olsen & Watts

(57) ABSTRACT

A positive-displacement oil pump is disclosed. In the oil pump, an insert body is fitted into a central opening of a shaft body to a height of an oil-feeding hole. The insert body is rotated along with the shaft body, and includes a central hole formed in the insert body, a cylindrical lip formed around an outlet of the central hole, a fluid discharge diode provided in an inlet of the central hole, and an inclined groove formed around an outer circumferential surface of the insert body such that the inclined groove forms a closed curve. A piston is movably fitted over the insert body such that the piston is axially moved while changing a volume of a displacement space defined between the insert body and the piston.

2 Claims, 4 Drawing Sheets

[Fig 1]
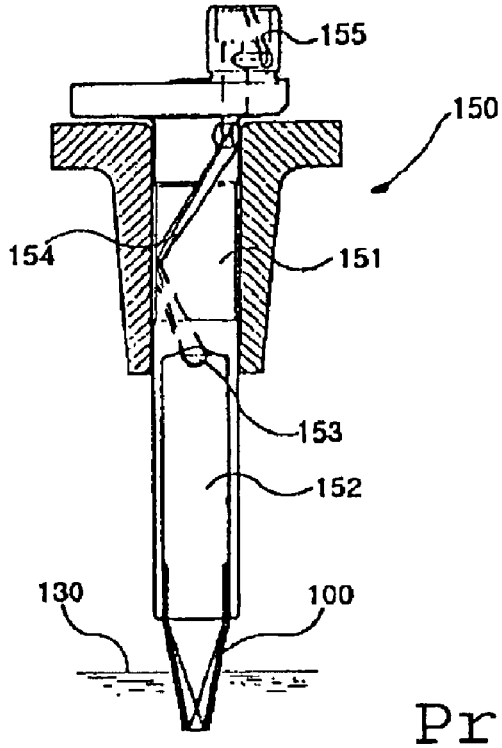
Prior Art
[Fig 2]
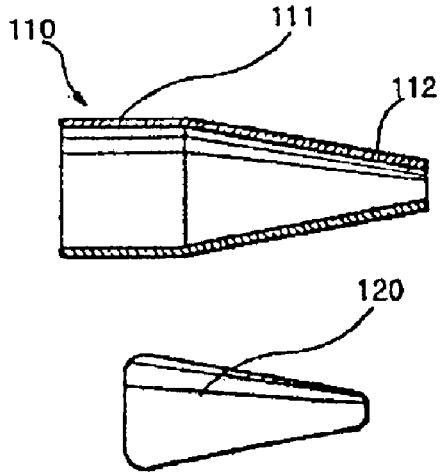
Prior Art

[Fig 3]
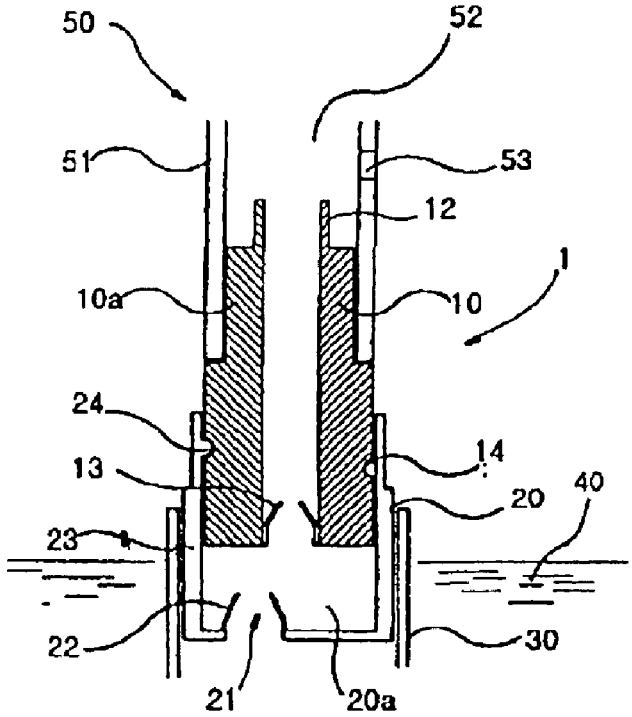
[Fig 4]
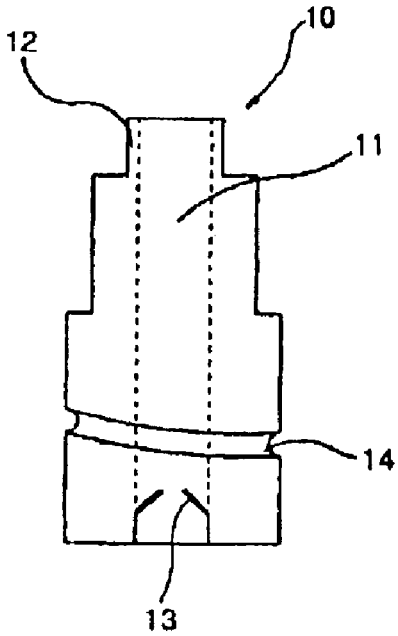

[Fig 5]
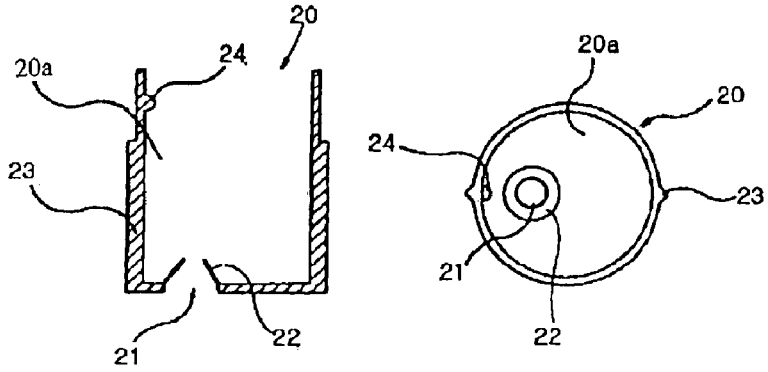
[Fig 6]
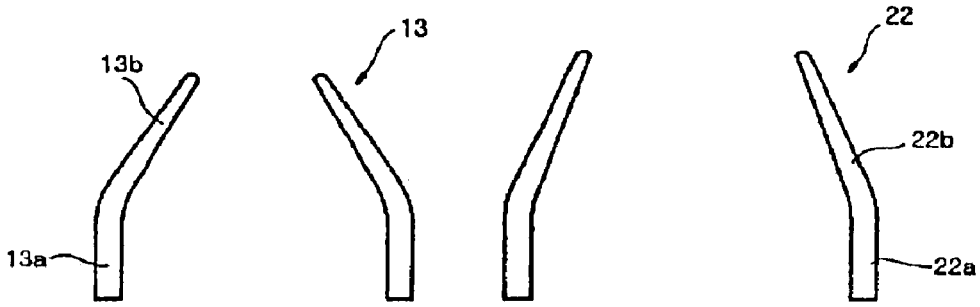
[Fig 7]
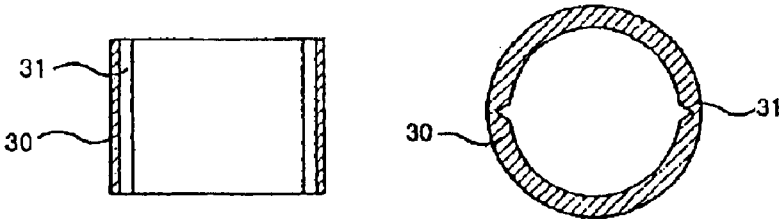

POSITIVE-DISPLACEMENT OIL PUMP

BACKGROUND OF THE INVENTION

1. Field of the Invention

The present invention relates, in general, to positive-displacement oil pumps and, more particularly, to a positive-displacement oil pump designed to reliably feed a sufficient amount of lubricating oil to a displacement compressor of refrigeration systems, such as refrigerators or air conditioners, regardless of a variation in the operational speed of the compressor.

2. Description of the Prior Art

As well known to those skilled in the art, conventional compressors for refrigeration systems typically use a centrifugal oil pump which is housed in a crankshaft and feeds lubricating oil to moving parts of a compressor using centrifugal force generated by rotation of the crankshaft.

A conventional centrifugal oil pump for compressors of refrigeration systems will be described herein below with reference to FIGS. 1 and 2.

FIG. 1 is a view of a crankshaft 150 of a refrigerant compressor, which includes a conventional centrifugal oil pump 100. FIG. 2 is a view showing an oil cap 110 and a propeller 120 included in the conventional centrifugal oil pump 100.

As shown in the drawings, the crankshaft 150 of a refrigerant compressor has a shaft body 151, with the conventional centrifugal oil pump 100 provided in the lower portion of the shaft body 151 such that the lower end of the pump 100 is immersed in lubricating oil contained in an oil reservoir 130.

That is, a central opening 152 is axially formed in the shaft body 151 of the crankshaft 150, and axially receives the centrifugal oil pump 100. An oil-feeding hole 153 is formed in the shaft body 151 such that the oil-feeding hole 153 extends from the top end of the central opening 152 to the outer circumferential surface of the shaft body 151. An oil guide groove 154 is formed around the circumferential surface of the shaft body 151 such that the oil guide groove 154 extends from the outside end of the oil-feeding hole 153 to a crank pin 155 provided at the upper end of the shaft body 151.

The conventional centrifugal oil pump 100 comprises an oil cap 110 and a conical propeller 120. The oil cap 110 consists of a cylindrical body part 111 and a conical tip part 112, with the conical propeller 120 axially set in the conical tip part 112.

When the crankshaft 150 is rotated, the centrifugal oil pump 100, axially inserted in the central opening 152 of the crankshaft 150, is also rotated. During such a rotation of the oil pump 100, lubricating oil contained in the oil reservoir 130 is introduced into the oil cap 110 through an inlet of the oil cap 110, and is forcibly lifted upward to the oil-feeding hole 153 due to centrifugal force generated by the rotation of both the propeller 120 and the central opening 152. At the outside end of the oil-feeding hole 153, the oil further flows forcibly upward through the oil guide groove 154 due to rotation of the crankshaft 150 relative to a journal bearing, thus reaching the crank pin 155 prior to being sprayed into the interior of a compressor's shell. The frictional contact surfaces of moving parts in the shell are thus lubricated.

In other words, when the crankshaft 150 is rotated, the centrifugal oil pump 100, provided in the lower portion of the crankshaft 150, is also rotated. During the rotation of the oil pump 100, the propeller 120 and the central opening 152 generate a pumping force for upwardly pumping the lubricating oil to a predetermined pumping head.

However, the oil pumping function of the crankshaft 150, which includes the centrifugal oil pump 100 and the central opening 152, is only due to the centrifugal force generated by rotation of the crankshaft 150. Therefore, when the rotating speed of the crankshaft 150 falls below a predetermined reference level, the pumping head of the oil pump 100 is quickly reduced. This means that it is almost impossible to feed an effective amount of lubricating oil to the moving parts inside the compressor's shell when the crankshaft 150 is rotated at low speed. In such a case, the moving parts of the compressor may suffer excessive abrasion at their frictional contact surfaces, and, furthermore, the heated frictional contact surfaces of the moving parts or the heated motor of the compressor may not be effectively cooled, thus occasionally causing overheating and severe damage. This results in severe damage or breakage of the compressor.

SUMMARY OF THE INVENTION

Accordingly, the present invention has been made keeping in mind the above problems occurring in the prior art, and an object of the present invention is to provide a positive-displacement oil pump, which reliably feeds a sufficient amount of lubricating oil from an oil reservoir to a variable speed refrigerant compressor even in the case of a low-speed operation of the compressor, thus preventing excessive frictional abrasion or overheating of the moving parts of the compressor.

In order to accomplish the above objects, the present invention provides a positive-displacement oil pump, comprising an insert body fitted into a central opening of a shaft body to be rotated along with the shaft body and including a central hole formed in the insert body along a central axis, a cylindrical lip formed around an outlet of the central hole, a fluid discharge diode provided in an inlet of the central hole, a piston movably fitted over a lower portion of the insert body such that the piston is axially moved relative to the insert body while changing a volume of a displacement space defined between the insert body and the piston, and is immersed at a lower portion thereof in oil contained in an oil reservoir, and including a fluid suction diode provided in a suction hole formed at a bottom wall of the piston, and a means for converting a rotation of the insert body into a vertical movement of the piston, and a guide means for guiding the vertical movement of the piston.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a view of a crankshaft of a refrigerant compressor, which includes a conventional centrifugal oil pump;

FIG. 2 is a view showing an oil cap and a propeller included in the conventional centrifugal oil pump;

FIG. 3 is a sectional view of a positive-displacement oil pump provided in the crankshaft of a refrigerant compressor in accordance with the present invention;

FIG. 4 is a view of an insert body included in the positive-displacement oil pump of the present invention;

FIG. 5 is a view of a piston included in the positive-displacement oil pump of the present invention;

FIG. 6 is a view of two fluid diodes included in the positive-displacement oil pump of the present invention;

FIG. 7 is a view of a piston guide included in the positive-displacement oil pump of the present invention;

DETAILED DESCRIPTION OF THE INVENTION

Figure 8:
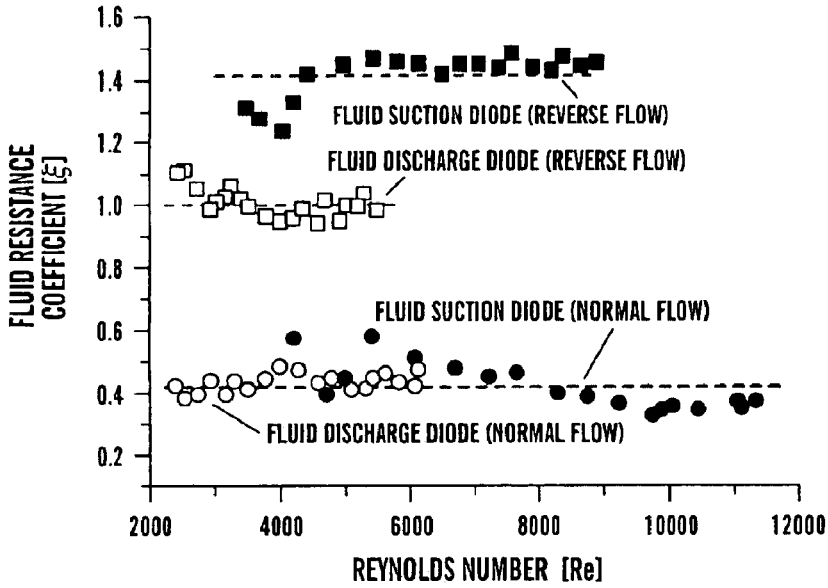
FIG. 8 is a diagrammatic view showing the fluid resistance characteristics of the fluid diodes included in the positive-displacement oil pump of the present invention.

Reference should now be made to the drawings, in which the same reference numerals are used throughout the different drawings to designate the same or similar components.

FIG. 3 is a sectional view of a positive-displacement oil pump provided in the crankshaft of a refrigerant compressor in accordance with the present invention.

As shown in FIG. 3, the positive-displacement oil pump 1 of the present invention comprises an insert body 10, a piston 20, and a piston guide 30. The insert body 10 is axially received in a central opening 52 that is axially formed in the shaft body 51 of the crankshaft 50, such that the insert body 10 is rotated along with the shaft body 51. The piston 20 is cup-shaped, and is axially and movably fitted over the lower portion of the insert body 10 such that the piston 20 is axially moved relative to the insert body 10 in a vertical direction while changing the volume of a cylindrical displacement space 20*a* defined between the lower surface of the insert body 10 and the bottom wall of the piston 20. The piston guide 30 axially and movably receives the piston 20 so as to guide an axial movement of the piston 20. The piston guide 30 is fixed on a support structure provided in the compressor's shell, such as a stator (not shown) of a motor.

In a detailed description, the insert body 10 is axially fitted into the central opening 52 of the shaft body 51 from the lower end of the opening 52 to a height at which an oil-feeding hole 53 is formed on the sidewall of the shaft body 51. The insert body 10 is thus rotated along with the shaft body 51. A central hole 11 is formed in the insert body 10 along the central axis of the body 10, with a cylindrical lip 12 axially formed along the edge of the outlet of the central hole 11. A fluid discharge diode 13 is provided in the inlet of the central hole 11. An inclined groove 14 is formed around the outer circumferential surface of the insert body 10 such that the groove 14 forms a closed curve. The cup-shaped piston 20 is axially and movably fitted over the lower portion of the insert body 10 such that the piston 20 is axially moved relative to the insert body 10 while changing the volume of the displacement space 20*a*. The piston 20 is immersed, at its lower portion, in lubricating oil contained in an oil reservoir 40, with a fluid suction diode 22 provided in a suction hole 21 formed at the bottom wall of the cup-shaped piston 20. Two axial ridges 23 are externally formed on the sidewall of the cup-shaped piston 20 at diametrically-opposed positions, while a projection 24 is formed on the inner surface of the piston's sidewall and movably engages with the inclined groove 14 of the insert body 10. The piston guide 30 is axially fitted over the piston 20 so as to guide an axial movement of the piston 20. The piston guide 30 is fixedly held on a support structure provided in the compressor's shell, such as the stator of a motor. Two axial grooves 31 are formed on the inner surface of the sidewall of the cylindrical piston guide 30 at diametrically-opposed positions, and engage with the two axial ridges 23 of the piston 20.

The above-mentioned elements of the positive-displacement oil pump 1 of the present invention will be described in more detail herein below, with reference to the drawings.

FIG. 4 is a view of the insert body 10 included in the positive-displacement oil pump 1.

As shown in FIG. 4, the insert body 10 is axially fitted into the central opening 52 of the shaft body 51 from the lower end of the opening 52 to a height, at which the oil-feeding hole 53 is formed on the sidewall of the shaft body 51, such that the insert body 10 is rotated along with the shaft body 51. The insert body 10 also has the central hole 11 along its central axis, with the cylindrical lip 12 formed along the edge of the outlet of the central hole 11. The inlet of the central hole 11 is provided with the fluid discharge diode 13, while the inclined groove 14 is formed around the outer circumferential surface of the insert body 10 in the form of a closed curve.

The central hole 11 has a predetermined diameter, and extends from the lower end to the upper end of the insert body 10 so as to form a lubricating oil path.

The cylindrical lip 12 axially extends from the edge of the outlet of the central hole 11 to a predetermined length. The lip 12 acts as a kind of partition wall between the central opening 52 of the crankshaft 50 and the central hole 11 of the insert body 10, and prevents lubricating oil from flowing backward from the central opening 52 into the central hole 11.

The fluid discharge diode 13, provided in the inlet of the central hole 11, is designed as follows: that is, when the lubricating oil normally flows from the displacement space 20*a* into the central hole 11 of the insert body 10, the fluid discharge diode 13 creates a flow resistance which is lower than that created by the diode 13 when the oil flows backward from the central hole 11 of the insert body 10 into the displacement space 20*a*. The fluid discharge diode 13 thus promotes the normal flow of the oil during an oil pumping operation. In order to accomplish the above object, the fluid discharge diode 13 preferably has a nozzle shape formed by an integration of a cylindrical body part 13*a* with a conical tip part 13*b*.

The inclined groove 14, formed around the outer circumferential surface of the insert body 10 in the form of a closed curve, converts a rotation of the insert body 10 into an axial linear reciprocation of the piston 20. In such a case, the stroke of the piston 20 is determined by a height difference between the highest position and the lowest position of the groove 14.

FIG. 5 is a view of the piston 20 included in the positive-displacement oil pump 1.

As shown in the drawing, the piston 20 is axially and movably fitted over the lower portion of the insert body 10 such that the piston 20 is axially moved relative to the insert body 10 while changing the volume of the displacement space 20*a*. The piston 20 is also immersed, at its lower portion, in the lubricating oil contained in the oil reservoir 40, with the fluid suction diode 22 provided in the suction hole 21 formed at the bottom wall of the cup-shaped piston 20. Externally formed on the sidewall of the cup-shaped piston 20 at diametrically-opposed positions are the two axial ridges 23, while the projection 24 is formed on the inner surface of the piston's sidewall so as to movably engage with the inclined groove 14 of the insert body 10.

Since the cup-shaped piston 20 is axially fitted over the lower portion of the insert body 10, the displacement space 20*a* is defined between the lower surface of the insert body 10 and the bottom wall of the piston 20. The displacement space 20*a* is changed in its volume in accordance with an axial movement of the piston 20 relative to the insert body 10, and the lubricating oil is sucked into and expelled from the displacement space 20*a* by the change in the volume of the space 20*a*.

The suction hole 21, formed at the bottom wall of the piston 20, acts as an inlet through which the lubricating oil is sucked from the oil reservoir 40 into the displacement space 20*a*. It is preferable to form the suction hole 21 at a position eccentric from the center of the bottom wall of the piston 20, as shown in the drawing.

The fluid suction diode 22, provided in the suction hole 21 such that the diode 22 is positioned in the displacement space 20*a*, is designed as follows: that is, when the lubricating oil normally flows from the oil reservoir 40 into the displacement space 20*a*, the fluid suction diode 22 creates a flow resistance which is lower than that created by the diode 22 when the oil flows backward from the displacement space 20*a* into the oil reservoir 40. The fluid suction diode 22 thus promotes the normal flow of the oil during an oil pumping operation. In order to accomplish the above object, the fluid suction diode 22 preferably has a nozzle shape formed by an integration of a cylindrical body part 22*a* with a conical tip part 22*b*.

The two axial ridges 23 are externally formed on the sidewall of the piston 20 at diametrically-opposed positions, and allow the piston guide 30 to be closely fitted over the piston 20 so as to guide an axial movement of the piston 20.

The projection 24 is formed on the inner surface of the piston's sidewall, and movably engages with the inclined groove 14 of the insert body 10.

FIG. 6 is a view of the two fluid diodes 13 and 22 included in the positive-displacement oil pump 1.

As shown in FIG. 6, the fluid discharge diode 13 has a nozzle shape formed by the integration of the cylindrical body part 13*a* with the conical tip part 13*b*. Due to the shape of the nozzle, the fluid discharge diode 13, in the case when the lubricating oil is normally flowing to be expelled from the displacement space 20*a* into the central hole 11 of the insert body 10, creates a flow resistance which is lower than that created by the diode 13 when the oil flows backward from the central hole 11 of the insert body 10 into the displacement space 20*a*. The fluid discharge diode 13 thus allows the oil to more effectively flow in an oil discharging direction during an oil pumping operation.

In the same manner, the fluid suction diode 22 has a nozzle shape formed by the integration of the cylindrical body part 22*a* with the conical tip part 22*b*. Due to the shape of the nozzle, the fluid suction diode 22, in the case when the lubricating oil is normally flowing to be sucked from the oil reservoir 40 into the displacement space 20*a*, creates a flow resistance which is lower than that created by the diode 22 when the oil flows backward from the displacement space 20*a* into the oil reservoir 40. The fluid suction diode 22 thus allows the oil to more effectively flow in an oil sucking direction during an oil pumping operation.

FIG. 7 is a view of the piston guide 30 included in the positive-displacement oil pump 1.

As shown in FIG. 7, the piston guide 30 axially and movably receives the piston 20 so as to guide the axial movement of the piston 20. The piston guide 30 is fixed on a support structure provided in the compressor's shell, such as the stator (not shown) of a motor. The two axial grooves 31 are formed on the inner surface of the sidewall of the piston guide 30, and movably engage with the two axial ridges 23 of the piston 20.

Due to the movable engagement of the axial ridges 23 of the piston 20 with the axial grooves 31 of the piston guide 30, the piston 20 is only allowed to linearly reciprocate relative to the piston guide 30 in an axial direction.

The operation and effect of the positive-displacement oil pump 1 according to the present invention will be described herein below.

When a refrigerant compressor starts its operation, the shaft body 51 of the crankshaft 50 set in a rotor (not shown) is rotated. The insert body 10, axially received in the central opening 52 of the shaft body 51, is thus rotated along with the shaft body 51 at the same rotating speed. In such a case, the rotating insert body 10 applies torque to the piston 20 through the projection 24 that is formed on the inner surface of the piston's sidewall and movably engages with the inclined groove 14 formed around the outer circumferential surface of the insert body 10. However, since the piston 20 is received in the fixed piston guide 30, with the two axial ridges 23 of the piston 20 movably engaging with the two axial grooves 31 formed on the inner surface of the sidewall of the piston guide 30, the piston 20 thus linearly reciprocates in a vertical direction. In such a case, the piston guide 30 is fixed on a support structure provided in the compressor's shell, such as a stator (not shown) of a motor.

When the piston 20 is moved downward relative to the rotating insert body 10, the displacement space 20*a* is enlarged in its volume, and is reduced in its pressure. In such a case, lubricating oil intends to flow into the space 20*a* from the outside of the space 20*a* through the two fluid diodes 13 and 22 in order to fill up the enlarged displacement space 20*a* of low pressure.

On the other hand, when the piston 20 is moved upward relative to the rotating insert body 10, the displacement space 20*a* is reduced in its volume, and is increased in its pressure. In such a case, lubricating oil intends to flow from the space 20*a* to the outside of the space 20*a* through the two fluid diodes 13 and 22.

In such a case, due to the specifically designed fluid diodes 13 and 22, the amount of oil flowing from the oil reservoir 40 into the displacement space 20*a* through the fluid suction diode 22 is larger than that flowing from the space 20*a* into the oil reservoir 40 through the diode 22. In the same manner, the amount of oil flowing from the displacement space 20*a* into the central hole 11 of the insert body 10 through the fluid discharge diode 13 is larger than that flowing from the central hole 11 into the space 20*a* through the diode 13.

FIG. 8 is a diagrammatic view showing the fluid resistance characteristics of the fluid suction diode 22 and the fluid discharge diode 13 of the positive-displacement oil pump 1 according to the present invention.

When there is a pressure difference ΔP between both ends of each fluid diode 13 or 22, and lubricating oil flows through the fluid diode 13 or 22 in a normal direction from the cylindrical body part 13*a* or 22*a* to the conical tip part 13*b* or 22*b* due to the pressure difference ΔP, the pressure difference ΔP is expressed by the following expression (1).

$$\Delta P=(1/2)\rho V^2+\xi^+(1/2)\rho V^2 \quad (1)$$

On the other hand, when there is a pressure difference ΔP between both ends of each fluid diode 13 or 22, and lubricating oil flows through the fluid diode 13 or 22 in a reverse direction from the conical tip part 13*b* or 22*b* to the cylindrical body part 13*a* or 22*a* due to the pressure difference ΔP, the pressure difference ΔP is expressed by the following expression (2):

$$\Delta P=(1/2)\rho V^2+\xi^-(1/2)\rho V^2 \quad (2)$$

In the above expressions (1) and (2), $\xi^+$ denotes a fluid resistance coefficient in the case of a normal flow of oil through each fluid diode 13 or 22, and $\xi^-$ denotes a fluid resistance coefficient in the case of a reverse flow of oil through each fluid diode 12 or 22. From the experimental results given in the diagrammatic view of FIG. 8, the fluid resistance coefficient $\xi_s^+$ in the case of a normal flow of oil through the fluid suction diode 22 is about 0.4, while the fluid resistance coefficient $\xi_s^-$ in the case of a reverse flow of oil through the fluid suction diode 22 is about 1.4. The fluid resistance coefficient $\xi_d^+$ in the case of a normal flow of oil through the fluid discharge diode 13 is about 0.4, while the fluid resistance coefficient $\xi_d^-$ in the case of a reverse flow of oil through the fluid discharge diode 13 is about 1.0. It is thus experimentally proven that the fluid resistance coefficient $\xi_s^+$ in the case of a normal flow of oil through the fluid suction diode 22 is substantially lower than the fluid resistance coefficient $\xi_s^-$ in the case of a reverse flow of oil through the fluid suction diode 22. In the same manner, it is apparent that the fluid resistance coefficient $\xi_d^+$ in the case of a normal flow of oil through the fluid discharge diode 13 is substantially lower than the fluid resistance coefficient $\xi_d^-$ in the case of a reverse flow of oil through the fluid discharge diode 13. In the above-mentioned characters $\xi_s^+$, $\xi_s^-$, $\xi_d^+$ and $\xi_d^-$, the subscript "s" denotes the fluid suction diode 22, while the subscript "d" denotes the fluid discharge diode 13. From the above description, it is noted that when the pressure difference between both ends of each fluid diode 13 or 22 is zero due to-the same pressure acting on both ends of the fluid diode 13 or 22, lubricating oil in the case of a normal flow more effectively and smoothly flows through the fluid diode 13 or 22 than the case of a reverse flow. Therefore, the flow rate of oil in the case of a normal flow through each fluid diode 13 or 22 is remarkably higher than that in the case of a reverse flow.

Due to such specifically designed fluid diodes 13 and 22, the positive-displacement oil pump 1 effectively feeds a predetermined amount of lubricating oil from the oil reservoir 40 into the central opening 52 of the shaft body 51 of the crankshaft 50 through both the fluid suction diode 22 and the fluid discharge diode 13 during one vertical reciprocation of the piston 20 relative to the rotating insert body 10.

Figure 9:
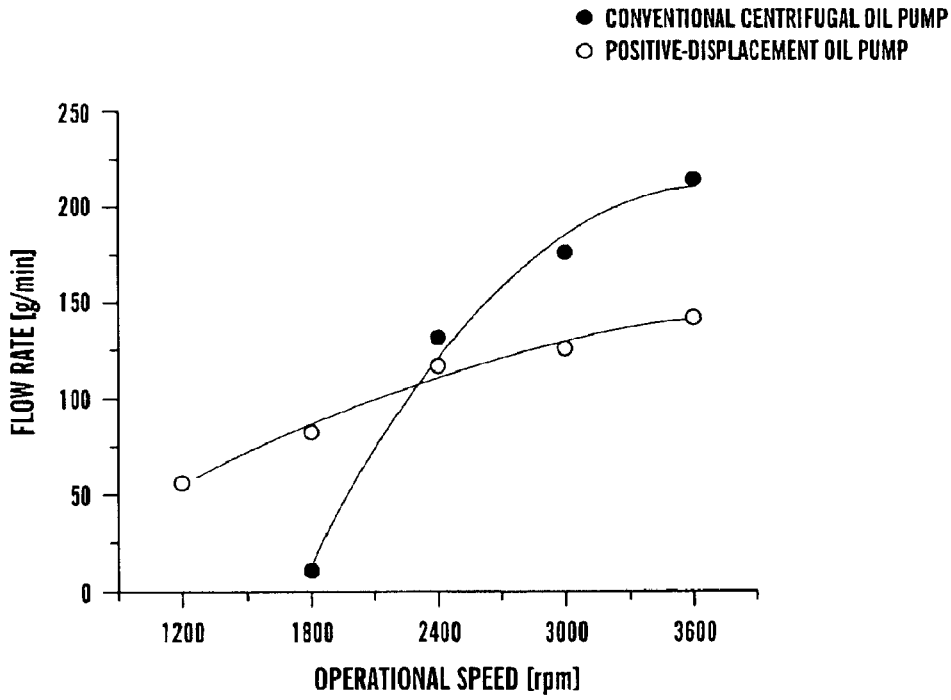
FIG. 9 is a diagrammatic view comparatively showing the flow rates of oil fed to refrigerant compressors by the positive-displacement oil pump of the present invention and by a conventional centrifugal oil pump.

FIG. 9 is a diagrammatic view comparatively showing the flow rates of oil fed to refrigerant compressors, operated at the same speed, by the positive-displacement oil pump of the present invention and by a conventional centrifugal oil pump.

As shown in FIG. 9, it is apparent that the positive-displacement oil pump 1 of the present invention feeds an effective amount of lubricating oil to moving parts of a compressor even when the compressor is operated at a low speed of about 1000 rpm, different from the conventional centrifugal oil pump 100 which cannot feed oil within a range where the compressor is operated at a speed not higher than 1800 rpm.

As described above, the present invention provides a positive-displacement oil pump which reliably feeds a sufficient amount of lubricating oil from an oil reservoir to moving parts of a refrigerant compressor even in the case of a low-speed operation of the compressor, thus preventing excessive frictional abrasion or overheating of the moving parts of the compressor.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A positive-displacement oil pump received in a central opening formed in a shaft body of a crankshaft, comprising:

an insert body fitted into the central opening of the shaft body from a lower end of said opening to a height at which an oil-feeding hole is formed on the shaft body, said insert body thus being rotated along with the shaft body and consisting of:

a central hole formed in the insert body along a central axis of said insert body;

a cylindrical lip formed around an outlet of said central hole;

a fluid discharge diode provided in an inlet of said central hole; and an inclined groove formed around an outer circumferential surface of the insert body such that the inclined groove forms a closed curve;

a piston movably fitted over a lower portion of said insert body such that the piston is axially moved relative to the insert body while changing a volume of a displacement space defined between the insert body and the piston, said piston being immersed at a lower portion thereof in oil contained in an oil reservoir, and consisting of:

a fluid suction diode provided in a suction hole formed at a bottom wall of said piston;

an axial ridge externally formed on a sidewall of the piston; and a projection formed on an inner surface of the sidewall of the piston and movably engaging with the inclined groove of said insert body; and a piston guide fitted over the piston so as to guide an axial movement of the piston, said piston guide being mounted on a support structure, and consisting of:

an axial groove formed on an inner surface of a sidewall of the piston guide so as to movably engage with the axial ridge of the piston.

2. The positive-displacement oil pump according to claim 1, wherein each of said fluid discharge diode and fluid suction diode has a nozzle shape formed by an integration of a cylindrical body part with a conical tip part.

* * * * *